US005126718A

United States Patent [19]

Doctor

[11] Patent Number: 5,126,718

[45] Date of Patent: Jun. 30, 1992

[54] INTRUSION DETECTION SYSTEM

[75] Inventor: Alan P. Doctor, Sea Cliff, N.Y.

[73] Assignee: Pittway Corporation, Syosset, N.Y.

[21] Appl. No.: 511,854

[22] Filed: Apr. 20, 1990

Related U.S. Application Data

[63] Continuation of Ser. No. 231,201, Aug. 11, 1988, abandoned.

[51] Int. Cl.[5] ..... G08B 13/18

[52] U.S. Cl. ..... 340/567; 340/556; 250/342; 250/349

[58] Field of Search ..... 340/567, 565, 566, 587, 340/555, 556; 250/342, 349, 338.3, 353

[56] References Cited

U.S. PATENT DOCUMENTS

| | | | |
|---|---|---|---|
| 3,524,180 | 8/1970 | Cruse | 340/523 |
| 3,543,261 | 11/1970 | Burney | 340/607 |
| 3,928,834 | 12/1975 | Sprout | 337/81 |
| 4,166,955 | 9/1979 | Keller | 250/342 |
| 4,218,620 | 8/1980 | Oettel | 250/338.3 |
| 4,263,585 | 4/1981 | Schaffer | 340/567 |
| 4,284,888 | 8/1982 | Appleby | 250/338.3 |
| 4,364,030 | 12/1982 | Rossin | 340/567 |
| 4,384,207 | 5/1983 | Doctor | 250/349 |
| 4,468,658 | 8/1984 | Rossin | 340/567 |
| 4,570,157 | 2/1986 | Kodaira | 340/567 |
| 4,614,938 | 9/1986 | Weitman | 340/567 |
| 4,618,854 | 10/1986 | Miyake et al. | 340/567 |
| 4,697,081 | 9/1987 | Baker | 250/338.3 |
| 4,769,545 | 9/1988 | Fraden | 340/567 X |
| 4,800,278 | 1/1989 | Taniguti et al. | 250/338.3 X |

*Primary Examiner*—Kenneth A. Wieder
*Attorney, Agent, or Firm*—Fish & Richardson

[57] ABSTRACT

An intrusion detection system includes an array of infrared radiation-sensitive elements, each element comprises first and second spaced electrodes between which pyroelectric material is positioned, and each element is operative to produce a voltage proportional to the rate of change of infrared radiation incident thereon. A pair of oppositely poled detector elements is connected to a first signal processing channel and a second pair of oppositely poled detector elements is connected to a second signal processing channel. The system also includes coincidence means such that an alarm output in response is produced in response to concurrent application of intruder signals of opposite polarity to the two signal processing channels.

16 Claims, 2 Drawing Sheets

INTRUSION DETECTION SYSTEM

This is a continuation of application Ser. No. 07/231,201, filed Aug. 11, 1988, now abandoned.

This invention relates to intrusion detection systems, and more particularly to systems with increased immunity to externally generated false alarms for detecting the presence of an intruder within the boundaries of an area under surveillence.

Numerous systems have been designed and are presently in use which use pyroelectric or other heat sensitive materials as intruder sensing elements. Pyroelectric materials include plastic film materials such as polyvinylidene fluoride, crystal materials such as lithium tantalate, and ceramic materials such as lead zirconate titanate. Such devices typically are poled, i.e., polarized, and have electrodes on their polarized areas such that, when radiant infrared energy falls upon the material, a small voltage appears between the electrodes due to internal transfer of electric charge that is amplified to signal an intrusion. Each sensor element is adapted to view one or more different areas in the space under surveillance (by means of focusing lenses or mirrors, for example). When an intruder enters one of the fields of view, the intruder's body heat causes a momentary change in the temperature of that sensor element which causes an output voltage to be produced across its load impedance. This voltage is amplified and an alarm signal is generated in response thereto.

Because these pyroelectric materials are extremely sensitive to temperature (and usually to pressure), the devices respond to environmental changes in pressure and temperature. In an effort to reduce false alarms generated by such environmental changes, pairs of sensitive areas (elements) have been connected in electrical opposition (series or parallel) for common mode rejection. In response to an environmental change, both elements are excited equally and because they are connected in electrical opposition, the output is cancelled and no alarm is generated. False alarms may be generated by other factors such as domestic pets or other small animals. Present intruder detection systems also tend to produce occasional output voltage artifacts in the form of "bursts" and/or spikes (due to defects in the elements, in the amplifiers or due to external sources, such as RFI, etc.) which cause false alarms.

In accordance with one aspect of the invention, there is provided an intrusion detection system that includes an array of infrared radiation-sensitive elements, each element comprising first and second spaced electrodes between which pyroelectric material is positioned, and each element being operative to produce a voltage proportional to the rate of change of infrared radiation incident thereon. A pair of oppositely poled detector elements is connected to a first signal processing channel and a second pair of oppositely poled detector elements is connected to a second signal processing channel to produce an output of opposite polarity. The system also includes coincidence means such that an alarm output in response is produced in response to concurrent application of intruder signals of opposite polarity, to the signal processing channels.

In preferred embodiments, the pyroelectric material has parallel opposed surfaces on which the electrode areas are located, the pyroelectric material is mounted in an hermetically-sealed metallic container, and impedance buffer elements in the container are close to the pyroelectric detector elements. While those impedance elements in a particular embodiment include FETs, other devices such as operational amplifiers may also be used. Focusing means, for example, a mirror or lens, is preferably included for forming multiple fields of view from the detector element array and focusing infrared radiation from the multiple fields of view on the infrared radiation-sensitive element array. In one particular embodiment, the elements are arranged in a rectangular array and pairs of oppositely polarized elements are interconnected in series opposition to the first and second amplifier channels. The radiation-sensitive elements are arranged so that one element of one pair is adapted to be illuminated by human intruder radiation concurrently with human intruder illumination of an element of the other pair and the polarization of the concurrently illuminated elements is such that output signals of opposite polarity are produced. In preferred embodiments, the pyroelectric material is selected from the class consisting of lithium tantalate, lead zirconate titanate, lead germanate, strontium barium niobate, and polyvinylidene fluoride. In a particular embodiment, each amplifier channel includes quiescent voltage cancelling circuitry, threshold circuitry, and coincidence circuit means that responds to output signals of opposite polarity.

Other features and advantages will be seen as the following description of a particular embodiment progresses, in conjunction with the drawings, in which.

DESCRIPTION OF PARTICULAR EMBODIMENT

Figure 1:
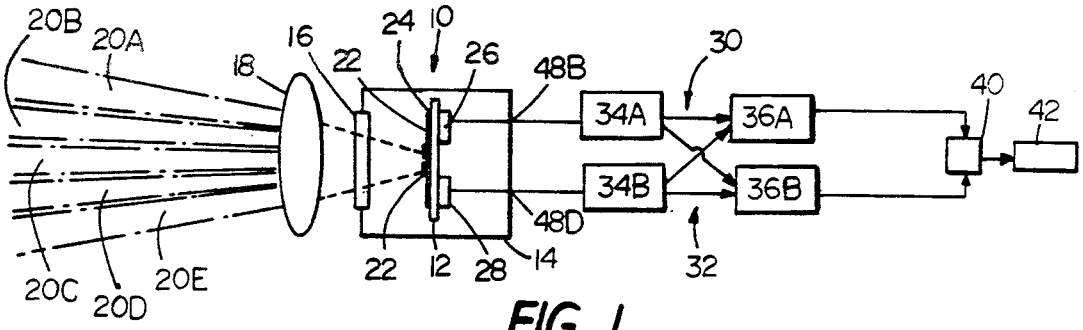
FIG. 1 is a diagrammatic view of an intrusion detection system in accordance with the invention.

With reference to FIG. 1, pyroelectric detector assembly 10 includes printed circuit board 12 and enclosure 14 that has an opening across which an infrared optical filter 16 (long wave passband that blocks wavelengths below six microns) is mounted. An optical system such as a mirror or other focusing element diagrammatically indicated at 18, focuses infrared radiation from fields of view 20 on sensor areas 22 of detector assembly 10. Four sensor areas 22 are arranged in a rectangular array on pyroelectric film 24 on board 12 and connected to buffer amplifiers 26, 28. Each buffer amplifier is connected to a corresponding amplifier channel 30, 32 and each channel includes a band pass amplifier 34, and a threshold detector circuit 36 which recognizes the coincidence signals of opposite polarity. The two channels are connected to exclusive or circuit 40 whose output is applied to output device 42.

Figure 2:
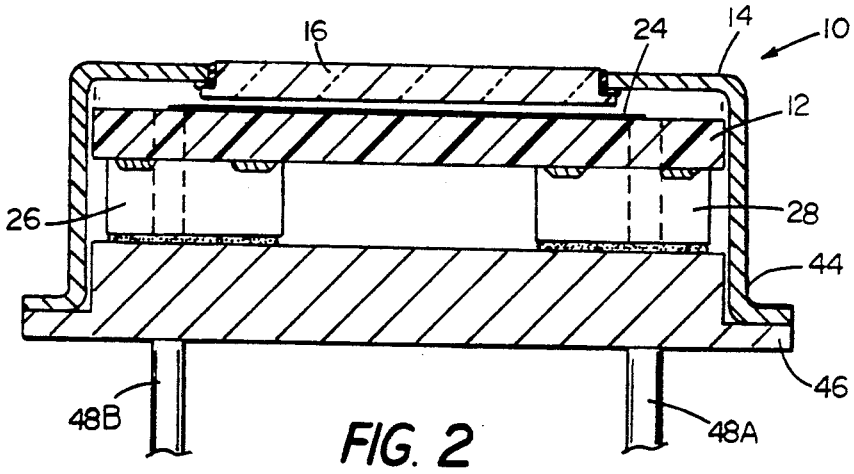
FIG. 2 is a side view, taking along the line 2—2 of FIG. 3, of the detector assembly shown in FIG. 3.
Figure 4:
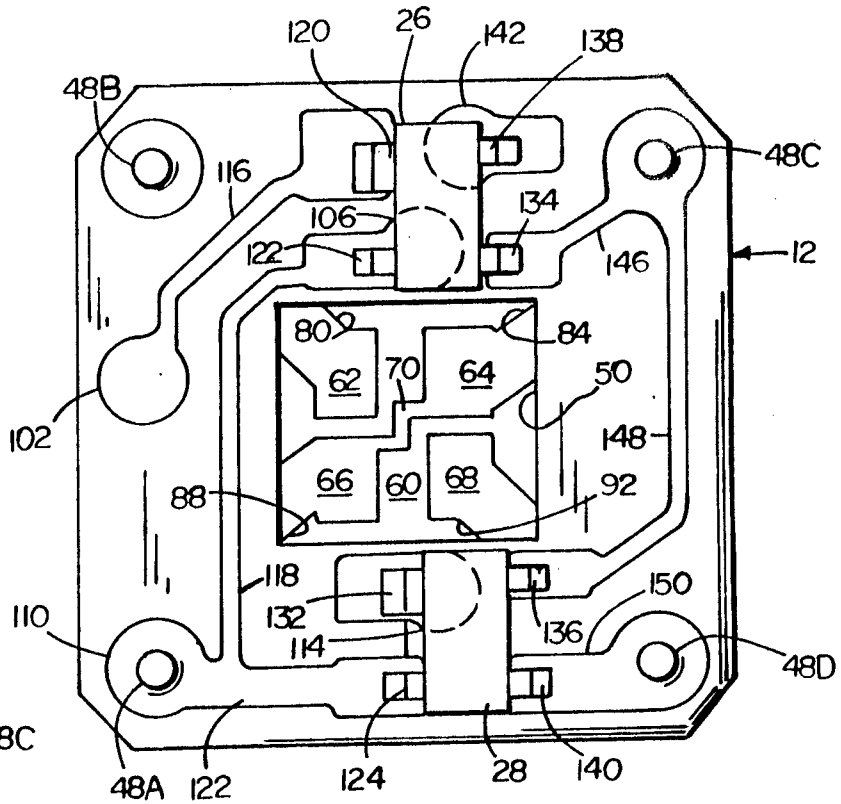
FIG. 4 is a bottom view of the PCB board and mounted components employed in the detector assembly shown in FIGS. 2 and 3.
Figure 3:
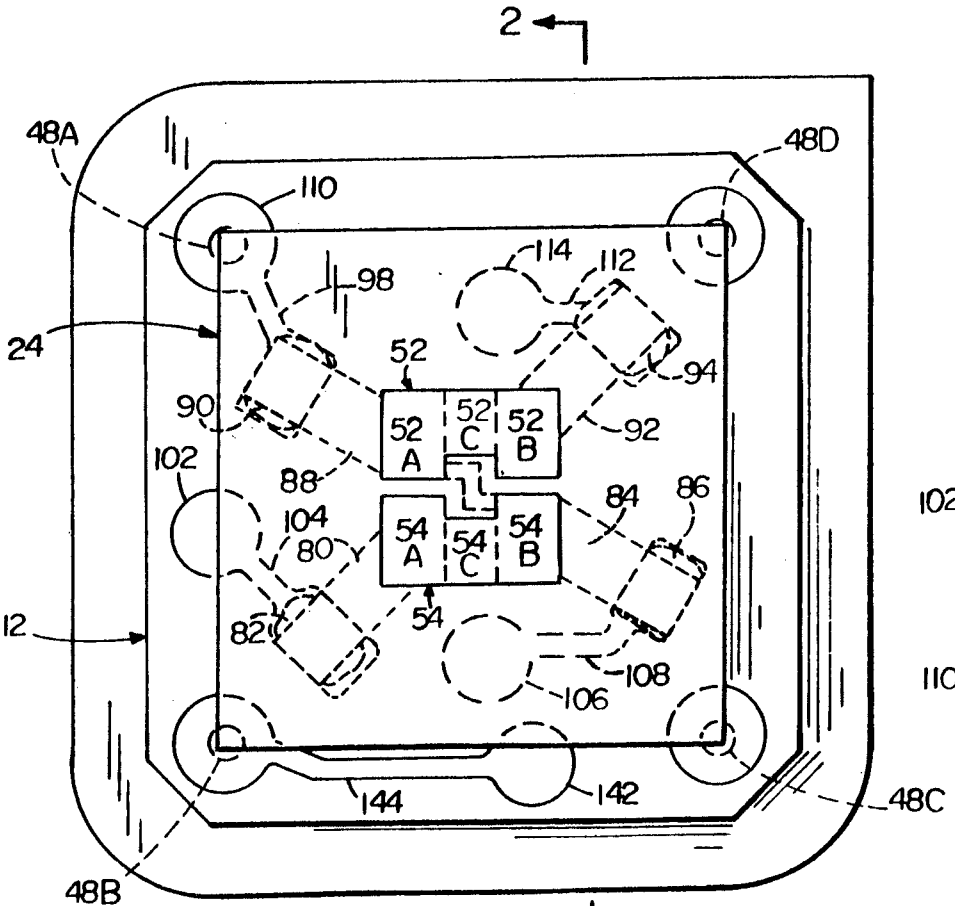
FIG. 3 is a top plan view (with cover removed), of a detector assembly in accordance with the invention.

Further aspects of the detector assembly may be seen with reference to FIGS. 2–4. With reference to FIG. 2, the detector assembly 10 includes cover 44 that includes silicon filter window 16 and header 46 that carries four connecting pins 48A–D that are spaced about three quarter centimeter on center. Mounted within container 14 is printed circuit board 12 that has aperture 50 (FIG. 4) and on which pyroelectric sensor film 24 is mounted.

While sensor film 24 is of polyvinylidene fluoride, a material commonly employed in pyroelectric detectors, other appropriate materials such as lithium tantalate, lead zirconate titanate, lead germanate or strontium barium niobate, for example, may be used. Film 24 is of rectangular configuration with an edge dimension cf about seven millimeters and a thickness of about nine micrometers. On the bottom surface of PC board 26 are mounted impedance conversion units 26, 28 that are adhesively secured to header 46.

With reference to FIG. 3, two electrode areas 52 and 54 are formed on upper surface of pyroelectric film 24 by vapor deposition. Electrode 52 has two sensing areas 52A, 52B that are interconnected by connector portion 52C and electrode 54 has sensing areas 54A, 54B that are interconnected by connector portion 54C. Deposited on lower surface 60 of pyroelectric film 24 are four corresponding electrode areas 62, 64, 66, 68, areas 64 and 66 being interconnected by strip 70. Deposited areas 52A and 66 form capacitor 72 (FIG. 5); deposited areas 52( and 68 form capacitor 74; deposited areas 54A and 62 form capacitor 76; and deposited areas 54B and 64 form capacitor 78.

Connecting strip 80 extends from area 62 to pad on the upper surface of PC board 12; conducting strip extends from area 64 to pad 86; conducting strip 88 extends from area 66 to pad 90; and conducting strip 92 extends from area 68 to pad 94. Each of the pads 82, 86, 90, 94 is connected to a corresponding through board connection 102, 106, 110, 114, respectively. With reference to FIG. 4, connection 102 is connected by conductor 116 to terminal 120 of transistor unit 26; connection 106 is connected to terminal 122 of unit 26, by conductor 118 to ground connection 110 (pin 48A) and by conductor 122 to ground terminal 124 of unit 28; and connection 114 is connected to terminal 132 of unit 28. Terminal pin 48B is connected by conductor 144 and through board connection 142 to terminal 138 of unit 26; pin 48C is connected by conductor 146 to B+ terminal 134 of unit 26 and by conductor 148 to B+ terminal 136 of unit 28; and pin 48D is connected by conductor 150 to terminal 140 of unit 28.

Figure 5:
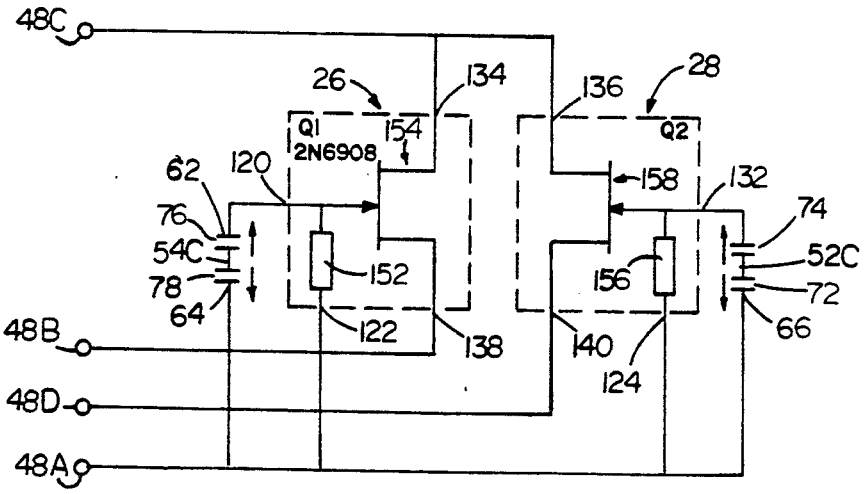
FIG. 5 is a schematic diagram of circuitry connected to the detector assembly of FIG. 1.

With reference to FIG. 5, unit 26 includes resistor 152 and field effect transistor 154; and similar unit 28 includes resistor 156 and transistor 158. The source of FET 154 is connected via terminal 138 to pin 48B; the gate of FET 154 is connected via terminal 120 to sensor 76; the drain of FET 154 is connected via terminal 134 to pin 48C (as is the drain of FET 158); the gate of FET 158 is connected via terminal 132 to sensor 74, and the source of FET 158 is connected via terminal 140 to pin 48D. As will be noted, sensors 72 and 74 are connected in series with opposite polarization, and sensors 76 and 78 are similarly connected in series with opposite polarization. The system is dimensioned such that infrared radiation from a human intruder will simultaneously impinge on elements 52A (sensor 72) and 54A (sensor 76) (FIGS. 2 and 5) in one field of view or on elements 52B (sensor 74) and 54B (sensor 78). However, infrared radiation from a small animal such as a domestic pet will impinge on only one element at a time.

With reference to FIG. 5, when an intruder concurrently illuminates sensors 72 and 76, charge is withdrawn from FET 158, reducing the signal from unit 28 at terminal 140 (pin 48D) while increasing the signal from unit 26 at terminal 138 (pin 48B). The resulting signals of opposite polarity are amplified by amplifiers 34A and 34B and applied to threshold-coincidence circuits 36A and 36B. Comparator 36A produces an output but circuit 36B has no output, and exclusive OR circuit 40 produces an output to energize alarm device 42. Oppositely polarized sensors 74 and 78 respond similarly when elements 52B and 54B are similarly concurrently illuminated by infrared radiation from an intruder and unit 28 produces an output that exceeds the threshold of circuit 36B but is of opposite polarity to the signal from unit 26. Exclusive circuit 40 responds and energizes output device 42 to provide an intruder indication only if units 26 and 28 simultaneously have outputs of opposite polarity. Should a noise impulse occur in only one circuit channel 30, no alarm signal is produced at the system output. Similarly, if the target is small so that only one sensor 72, 74, 76 or 78 is illuminated, no alarm signal will be produced. The system also discriminates against thermal or radiation changes or shocks to the container 14 which affect all of the sensors in the same manner. Also, if an external transient causes the system to produce alarm level signals but of like polarity, no alarm is indicated.

While a particular embodiment of the invention has been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. An intrusion detection system comprising a member of pyroelectric material, a plurality of infrared radiation-sensitive elements, each said element comprising first and second spaced electrodes between which a portion of said member of pyroelectric material is positioned, each element being operative to produce a voltage proportional to the rate of change of infrared radiation incident thereon, the pyroelectric material portion of each element being polarized, said elements being electrically connected together in pairs of oppositely-polarized elements, said radiation sensitive elements being arranged so that one element of one of said pairs sis adapted to be illuminated by human intruder radiation concurrently with human intruder illumination of one element of the other pair and the polarization of the concurrently illuminated elements is such that output signals of opposite polarity are produced when one element of one of said pairs is illuminated by human intruder radiation concurrently with human intruder illumination of an element of another of said pairs of said radiation sensitive elements, first and second amplifier channels, means connecting each of said pairs of oppositely polarized elements to a corresponding amplifier channel, and coincidence means connected to said amplifier channels for producing an alarm output only in response to concurrent generation of intruder signals of opposite polarity by said infrared radiation-sensitive elements.

2. The system of claim 1 wherein said pyroelectric material is mounted in an hermetically-sealed metallic container.

3. The system of claim 2 and further including impedance buffer elements in said container close to said infrared radiation-sensitive elements.

4. The system of claim 1 and further including focusing means for forming multiple fields of view for said detection system and focusing infrared radiation from said multiple fields of view on said plurality of infrared radiation-sensitive elements.

5. An intrusion detection system comprising a member of pyroelectric material, a plurality of infrared radiation-sensitive elements, each said element comprising first and second spaced electrodes between which a portion of said member of pyroelectric material is positioned, each element being operative to produce a voltage proportional to the rate of change of infrared radiation incident thereon, the pyroelectric material portion of each element being polarized, said elements being electrically connected together in pairs of oppositely-polarized elements, first and second amplifier channels, pairs of said infrared radiation-sensitive elements being interconnected in series opposition to respective ones of said first and second amplifier channels, means connecting each of said pairs of oppositely polarized elements to a corresponding amplifier channel, said infrared radiation-sensitive elements being arranged in a rectangular array of four electrodes on one surface of said pyroelectric member, said four electrodes being horizontally and vertically spaced from one another, a corresponding array of four electrodes on the opposite surface of said pyroelectric member, focusing means for forming multiple fields of view for said detection system and focusing infrared radiation from said multiple fields of view on said plurality of infrared radiation-sensitive elements, said focusing means being proportioned so that human intruder radiation concurrently illuminates both of said vertically spaced electrodes of each pair on said one surface while radiation from a small animal illuminates only one of said vertically spaced electrodes of each pair, first and second electrode interconnection means on said one surface of said pyroelectric member electrically interconnecting the horizontally spaced electrodes of each said pair of radiation sensitive elements, third electrode interconnection means on said opposite surface of said pyroelectric member providing a diagonal electrical interconnection between the lower vertically spaced electrode of one of said pairs of elements and the upper vertically spaced electrode of the other of said pairs of elements, the polarization of the concurrently illuminated elements being such that output signals of opposite polarity are produced when one element of one of said pairs is illuminated by human intruder radiation concurrently with human intruder illumination of an element of another of said pairs of said radiation sensitive elements, and coincidence means connected to said amplifier channels for producing an alarm output only in response to concurrent generation of intruder signals of opposite polarity by said infrared radiation-sensitive elements.

6. The system of claim 5 wherein each said amplifier channel includes threshold circuitry, and coincidence means that responds to output signals of opposite polarity.

7. The system of claim 6 wherein said pyroelectric material is mounted in an hermetically-sealed metallic container, and further including impedance buffer elements in said container close to said infrared radiation-sensitive elements.

8. The system of claim 7 wherein said pyroelectric material is selected from the class consisting of lithium tantalate, lead zirconate titanate, lead germanate, strontium barium niobate, and polyvinylidene fluoride.

9. An intrusion detection system comprising an array of infrared radiation-sensitive elements, each said infrared radiation-sensitive element comprising first and second spaced electrodes between which pyroelectric material is positioned, and each said infrared radiation-sensitive element being operative to produce a voltage proportional to the rate of change of infrared radiation incident thereon, first and second signal processing channels, a first pair of said infrared radiation sensitive elements being connected in oppositely poled series relation and being connected to said first signal processing channel and a second pair of said infrared radiation-sensitive elements being connected in oppositely poled series relation and being connected to said second signal processing channel to produce an output of opposite polarity, said radiation sensitive elements being arranged so that one element of one of said pairs is adapted to be illuminated by human intruder radiation concurrently with human intruder illumination of one element of another pair and the polarization of the concurrently illuminated elements is such that output signals of opposite polarity are produced when one element of one of said pairs is illuminated by human intruder radiation concurrently with human intruder illumination of an element of said another pair of said radiation sensitive elements, and coincidence means for producing an alarm output in response to concurrent application to both of said signal processing channels from said radiation-sensitive elements of intruder signals and the intruder signal applied to one signal processing channel is of opposite polarity to the intruder signal concurrently applied to the other signal processing channel.

10. The system of claim 9 wherein said infrared radiation-sensitive elements are arranged in a rectangular array of four electrodes on one surface of said pyroelectric material, said four electrodes being horizontally and vertically spaced from one another, a corresponding array of four electrodes on the opposite surface of said pyroelectric material, first and second electrode interconnection means electrically interconnecting the horizontally spaced electrodes of each said pair of radiation sensitive elements, and third electrode interconnection member providing a diagonal electrical interconnection between the lower vertically spaced electrode of one of said pairs of elements and the upper vertically spaced electrode of the other of said pairs of elements on said opposite surface of said pyroelectric material, and pairs of said infrared radiation-sensitive elements are interconnected in series opposition to respective ones of said first and second signal processing channels.

11. The system of claim 9 wherein each of said infrared radiation sensitive elements comprises pyroelectric material with parallel opposed surfaces on which said electrodes are located.

12. The system of claim 11 wherein said pyroelectric material is mounted in an hermetically-sealed container, and further including impedance buffer elements in said container close to said infrared radiation-sensitive elements.

13. The system of claim 12 and further including focusing means for forming multiple fields of view for said detection system and focusing infrared radiation from said multiple fields of view on said infrared radiation-sensitive element array.

14. The system of claim 13 wherein said pyroelectric material is selected from the class consisting of lithium tantalate, lead zirconate titanate, lead germanate, strontium barium niobate, and polyvinylidene fluoride.

15. The system of claim 14 wherein each said signal processing channel includes threshold circuitry, and coincidence means that responds to output signals of opposite polarity.

16. The system of claim 15 wherein each said impedance buffer element includes a field effect transistor.

* * * * *